US006560409B2

(12) United States Patent
Troost, IV

(10) Patent No.: US 6,560,409 B2
(45) Date of Patent: May 6, 2003

(54) HOT WATER HEATER STACKING REDUCTION CONTROL

(75) Inventor: Henry E. Troost, IV, River Falls, WI (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/745,686

(22) Filed: Dec. 22, 2000

(65) Prior Publication Data

US 2001/0031138 A1 Oct. 18, 2001

Related U.S. Application Data

(60) Provisional application No. 60/174,232, filed on Jan. 3, 2000.

(51) Int. Cl.[7] ..... H05B 1/02
(52) U.S. Cl. ..... 392/498; 392/449; 219/494
(58) Field of Search ..... 398/498, 441, 398/449; 219/494, 482, 485, 490, 496; 392/463, 464

(56) References Cited

U.S. PATENT DOCUMENTS 5,968,393 A * 10/1999 Demaline ..... 219/485
6,208,806 B1 * 3/2001 Langford ..... 392/449
6,350,967 B1 * 2/2002 Scott ..... 219/485
6,375,087 B1 * 4/2002 Day et al. ..... 122/447

FOREIGN PATENT DOCUMENTS

EP 0356609 A 3/1990

* cited by examiner

*Primary Examiner*—Teresa Walberg
*Assistant Examiner*—Thor Campbell

(57) ABSTRACT

A control system for a hot water heater includes a reservoir for containing hot water, a cold water feed for the reservoir, a hot water exit for the reservoir and means for supplying energy to heat water in the reservoir. A temperature monitoring probe associated with the reservoir monitors the temperature of the reservoir. The frequency of removal of water from the reservoir is monitored. There are means for relating the temperature and frequency of water removal to control the operation of the energy means for supplying heat to the reservoir. The frequency of water usage is signaled by monitoring the water temperature in the reservoir, the water flow from the reservoir, or the pressure of water in the reservoir. Based upon the frequency determination, the setpoint of the heating system can be adjusted so that stacking is avoided.

22 Claims, 2 Drawing Sheets

HOT WATER HEATER STACKING REDUCTION CONTROL

The present application claims the benefit and priority of U.S. Provisional application Ser. No. 60/174,232, filed on Jan. 3, 2000, and entitled HOT WATER HEATER STACKING REDUCTION CONTROL.

BACKGROUND OF THE INVENTION

This invention relates to hot water heaters. More specifically, the present invention relates to a control system which controls the operation of the water heater.

During the heating cycle in a typical storage type hot water heater hot water tends to rise to the top and cold water settles on the bottom of the storage tank of the heater. The amount of difference in temperature between the top of the tank and the bottom is affected by many parameters including placement of the thermostat temperature monitoring probe, BTUs size of the heater, material selection for the tank, combustion compartment, the rate and frequency of water usage and others. This difference in temperature between the top of the tank and bottom is commonly referred to as "stacking."

In order to prevent excessively hot water at the top of the tank it would be ideal to place the thermostat temperature monitoring probe in the very top of the tank. However, by placing the probe in this location the capacity (gallons of hot water available per hour) is reduced because the heater turns off before water in the lower portion of the tank has been warmed. To gain the most capacity, the thermostat-temperature monitoring probe would be placed near the bottom of the tank. However, this allows excessively hot water to stratify at the top of the tank.

Traditionally, the thermostat-temperature monitoring probe used is essentially an electrical switch. An expandable fluid is contained within the probe and is associated with appropriate electrical contacts. As water is heated, the fluid within the probe expands thus opening the electrical contacts. This switch is typically connected directly to the heating system. Consequently, opening of this switch simply results in the turning off of the heating element. This type of switching mechanism is very typical for most thermostatic/heating devices.

In current hot water storage tank heaters a significant amount of development is spent in identifying the exact location to place the probe that will trade off capacity against the maximum water temperature under worse case stacking conditions. One of the solutions has been to use two probes which average the temperature near the top of the tank with the temperature at a lower location thus providing a better trade off in maximum temperature against capacity. All of the solutions are geared at passing the American National Standards Institute test for stacking found in ANSI Z21.10.1 and ANSI Z21.10.3. These solutions are not accurate, trade off capacity against the maximum temperature, and do not react to stacking at rates and temperatures different than found in the ANSI Standards.

As these ANSI Standards recognize, the phenomena of stacking is most prominent in conditions where the hot water supply is cycled on and off frequently. That is, stacking is encountered in situations where the hot water is drawn to a point where the heating source is required to turn on, and then the water is turned off shortly thereafter. In this situation, a substantial amount of heated water already exists in the tank. Applying further heat or additional energy to the tank at this point magnifies the stacking problem by further raising the temperature of water contained in the upper portion of the tank.

As can be appreciated, continuous cycling over long periods of time can create further unwanted stacking, as outlined above.

The result of the aforementioned inadequacies is excessively hot water during some usage cycles, inadequate hot water during other usage cycles and the need for storage tank heaters larger than required. This also results in excessive cost to the consumer, to compensate for the sensor location compromises previously discussed.

This invention seeks to minimize the disadvantages of the known systems.

SUMMARY OF THE INVENTION

According to the invention, there is provided a control system for a hot water heater which includes a reservoir for containing hot water, a cold water feed for the reservoir, a hot water exit for the reservoir and a system for supplying energy to heat water in the reservoir.

A temperature monitoring probe is associated with the reservoir for monitoring the temperature of the water therein. Temperature is continually monitored to determine information about the frequency of water removal from the reservoir. Specifically, temperature pattern can suggest how frequently water is being removed from the reservoir. This information regarding the temperature patterns of the water, and the related frequency of water removal are used to control the operation of the energy system for supplying heat to the reservoir which reduces stacking. The frequency of water usage can also be determined by directly monitoring the flow of water from the reservoir, or the pressure of water in the reservoir.

A microprocessor based control is attached to the temperature monitoring probe to carry out the thermostat function. In addition to other functions, the microprocessor provides signals which will turn the heating source on or off under the right conditions. As is typical, when the microprocessor based control recognizes that the temperature monitoring probe temperature is below a desired level, the heating system is activated to provide heat to water in the tank. Additionally, by having the temperature monitoring probe attached to a microprocessor, trends and patterns in the heating process can be monitored. More specifically, the microprocessor can monitor the period of time between consecutive calls for heat. By this monitoring, the microprocessor can keep track of water conditions in the reservoir.

A temperature control set point for the heating control is selectively depressed in response to the water use patterns in the reservoir. Selectively depressing the temperature control set point is used to compensate for the difference in temperature between the top of a water reservoir and the bottom of a water reservoir. The set point of the temperature control of the thermostat is returned to a higher level when the frequency of water extraction from the reservoir decreases.

The microprocessor is further preprogrammed to permit a predetermined amount of control temperature set point depression relative to the frequency of usage. The programming of the microprocessor on a custom basis is possible for different respective reservoir installations. That is, the basic control algorithm in the microprocessor can be customized for each model of reservoir that is used. The setting is determined according to specific usage patterns which effect each particular reservoir. The preset is activated when the temperature control is set to the maximum or selectively at any predetermined set point.

The microprocessor is programmable so that depressing the temperature for a different predetermined number of degrees at a preselected time interval is possible. The amount of depression may be at least one of cumulative amounts or preset amounts. The timing and the amount of temperature increments to return to an original setting is selectable.

The foregoing and other objects, features, and advantages of the present invention will be apparent from the following detailed description of the preferred embodiments which makes reference to several drawing figures.

DETAILED DESCRIPTION OF THE PREFERRED EMBODIMENT

In the following description of the preferred embodiments reference is made to the accompanying drawings which form the part thereof, and in which are shown by way of illustration of specific embodiments in which the invention may be practiced. It is to be understood that other embodiments may be utilized and structural and functional changes may be made without departing from the scope of the present invention.

Figure 1:
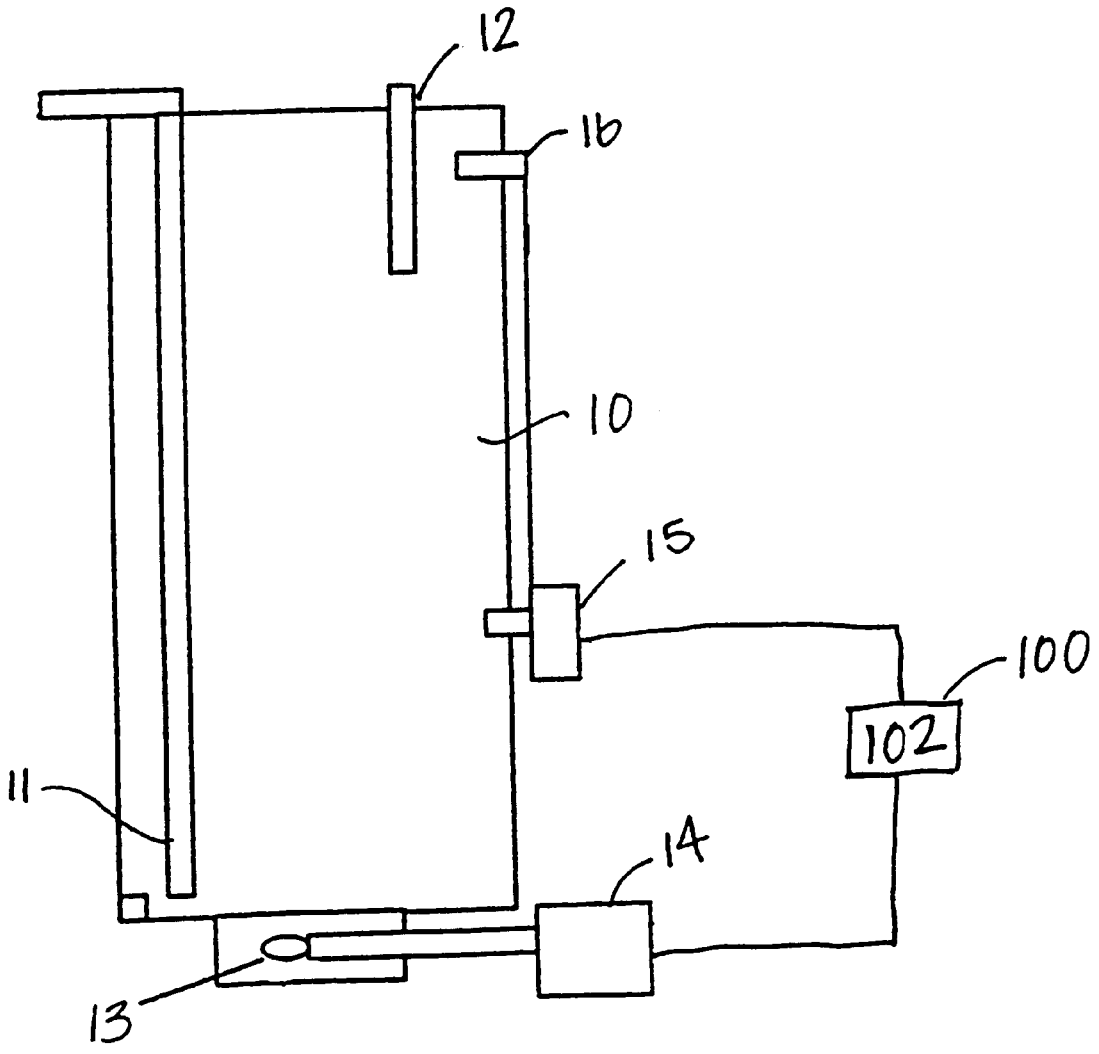
FIG. 1 is a representation of a water reservoir with thermostats and temperature monitoring probes.

A water heating system for a hot water heater (FIG. 1) includes a reservoir 10 for containing hot water. There is a cold water feed 11 for the reservoir 10, a hot water exit 12 for the reservoir 10 and an energy source 13 for supplying energy to heat water in the reservoir 10. This energy source 13 can be powered by gas or oil through primary fuel control 14. There can be many different energy sources, such as electricity. A temperature monitoring probe 15 is associated with the reservoir 10 for monitoring the temperature of the reservoir. This probe 15 can also provide information related to the frequency of removal of water from the reservoir 10. There can be an additional temperature monitoring probe 16 towards the top of the reservoir 10. This probe 16 can also monitor water temperature and provide information regarding the frequency of water usage. Alternatively, separate probes could be included to independently measure water removal rate (flow rate).

A control system 100 is used to receive signals indicative of the water temperature and the frequency of water removal, and to subsequently control the operation of the energy source 13 which supplies heat to the reservoir 10. The frequency of water usage is signaled by monitoring the temperature characteristics from the reservoir. This temperature monitoring is achieved by one or more of the temperature monitoring probes 15 or 16.

To void the aforementioned problems related to stacking, a temperature control set point is selectively depressed in response to the water conditions in the reservoir 10. Selectively depressing the temperature control set point compensates for the difference in temperature between the top of a water reservoir 10 and the bottom of a water reservoir 10 by not providing excessive amounts of energy. The set point of the temperature control system 100 is returned to a higher level when the frequency of water extraction from the reservoir decreases. The probes 15 and 16 and the energy source are all coupled to the control system 100.

A microprocessor 102 is provided in the control system 100 or is directly associated with respectively or collectively one or more of the probes 15 and/or 16. The probes 15 and 16 are connected together and are connected to the microprocessor 102. Microprocessor 102 is preprogrammed to appropriately adjust the temperature set point relative to the frequency of usage. Alternatively or additionally, the setting of the microprocessor on a custom basis is permitted for each reservoir installation. The setting is determined according to specific usage patterns for the particular water heater 10 (i.e. parameters of the tank and energy delivery system). The setpoint depression can be activated when the temperature control is set to the maximum or at any set point. In addition, the microprocessor is programmed to carry out the thermostat function for the control system. That is, the microprocessor provides signals which energize the heating system when the control temperature is below a predetermined point. Alternatively, signals are provided which will turn off the heating system once a desired water temperature is achieved.

An example of the system operation is now described. The microprocessor is programmed to reduce the thermostat set point temperature about 1° F. each time a second requirement for heating is made within about 17 minutes. The reduction of the thermostat set point is cumulative. That is, in the event of a further call for heat occurs within about the next 17 minutes, a total of 2° F. reduction in thermostat set point is permitted. The depression of the temperature set point continues until a time period in excess of about 17 minutes occurs without a call for heat. At this point the microprocessor begins to raise the set point to its original setting in about 30 minutes.

The temperature can be depressed for a different predetermined number of degrees at a preselected time interval. The amount of depression may be either cumulative or preset, and the timing and the amount of temperature increments to return to an original setting is variable.

This system uses a microprocessor, or other electronics, timers, circuits or devices to monitor the temperature through the thermostat function. The frequency of water usage is signaled by a need for energy to be supplied to the water. Other implementations could use flow monitoring and/or pressure monitoring.

The temperature control set point is depressed to compensate for those conditions which cause stacking to occur during the symptomatic usage periods. The setpoint is returned to the "normal" setting as water usage frequency falls off. This control can be preprogrammed for a generic amount of control temperature setpoint depression and frequency of usage. Alternatively, setting the system in the field is possible so that each installation can be customized to fit specific usage patterns unique to that installation. This feature could be enacted when a temperature control is set to its maximum or could be implemented at any setpoint.

Other implementations of the software code of the microprocessor may depress the temperature differently to that described, namely more or less and at different time intervals.

Figure 2:
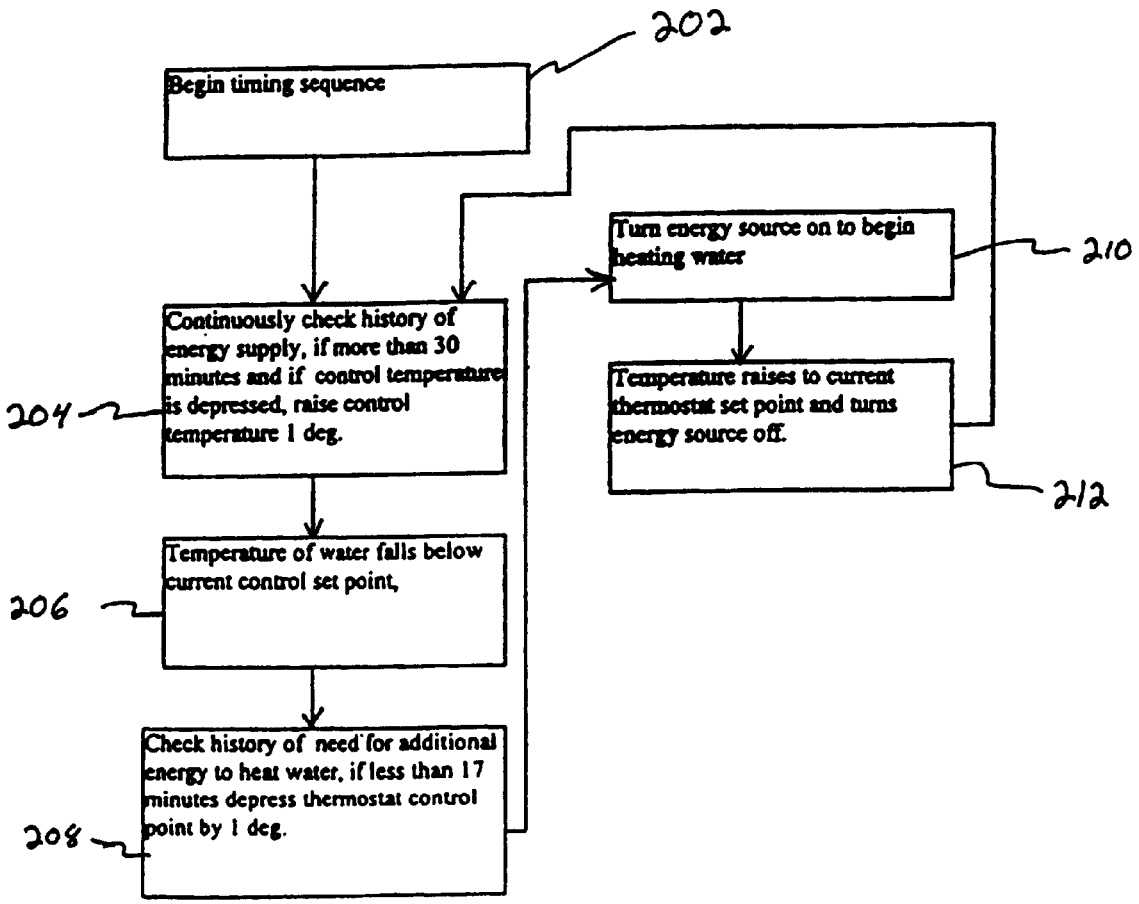
FIG. 2 is a flow diagram illustrating the timing sequence.

Referring to FIG. 2, there is shown a flow diagram illustrating one embodiment of a control sequence of the present invention. Utilizing this control diagram, the process begins at step 202. In step 204, the system continuously checks the history of the energy supply system. If the control temperature has been depressed and it has been more than 30 minutes since the system called for heat, the set point is raised one degree. In step 206, the system monitors temperature to determine if the water temperature falls below the current control setpoint. If it does, the process moves to step 208 where the history is checked to see if it has been less than 17 minutes since the previous call for heat. If yes, the control point is reduced by one degree. Next, regardless of whether the control point is modified, if the water temperature is below the setpoint, the system turns on the energy source to begin heating the water in step 210. As expected, once the water temperature raises to the current thermostat setpoint, in step 212 the energy source is turned off. Again, the system will loop back to step 204 where the history is checked.

The foregoing description of the preferred embodiments of the invention has been presented for the purposes of illustration and description. It is not intended to be exhaustive or to limit the invention to the precise form disclosed. Single or multiple probes and sensors can be used at different strategic locations with the reservoir. Each may be differently programmed. One or more of the probes is responsive to at least one of water temperature, water flow from the reservoir and/or pressure of water in the reservoir. Different combinations are possible. In the net result, a more efficient use of energy for operating hot water heaters is achieved.

Many modifications and variations are possible in light of the above teaching. It is intended that the scope of the invention be limited not by this detailed description, but rather by the claims appended hereto.

What is claimed is:

1. A control system for a hot water heater including:

a reservoir for hot water, a cold water feed for the reservoir, a hot water exit for the reservoir and a heating source for supplying energy to heat water in the reservoir;

a temperature monitoring probe associated with the reservoir for monitoring the temperature of the reservoir;

a thermostat associated with the water in the reservoir; and a controller for determining the frequency of removal of water from the reservoir based upon this monitoring, the controller for further relating the temperature and frequency of water removal to control the operation of the thermostat temperature control set point.

2. A system as claimed in claim 1 wherein the frequency of water removal is determined by temperature monitoring, water flow from the reservoir, or the pressure of water in the reservoir, the need for using energy.

3. A system as claimed in claim 1 wherein the frequency of water removal is determined by monitoring water flow.

4. A system as claimed in claim 1 wherein the frequency of water removal is determined by monitoring water pressure.

5. A system as claimed in claim 1 including depressing a temperature control set point of the thermostat in response to a water temperature condition in the reservoir and the frequency of water removal.

6. A system as claimed in claim 5 including returning the set point of the temperature control of the thermostat to a higher level when the frequency of water extraction from the reservoir decreases.

7. A system as claimed in claim 6 including preprogramming a microprocessor related to the thermostat probe to permit a predetermined amount of control temperature set point depression relative to frequency of usage.

8. A system as claimed in claim 1 including a microprocessor with the temperature monitoring probe, the setting of the microprocessor being effected for the reservoir, the setting being determined according to a usage pattern associated relative to the use of the water heater.

9. A system as claimed in claim 8 including presetting the temperature control towards a maximum set point or selectively another set point.

10. A system as claimed in claim 9 including the steps of programming the microprocessor to reduce the thermostat set point temperature about 1° F. each time a second requirement for heating is made within about 17 minutes.

11. A system as claimed in claim 10 wherein the reduction of the thermostat set point is cumulative in the event of a further requirement for heating occurs within about the next 17 minutes, thereby permitting a total of 2° F. reduction in thermostat set point.

12. A system as claimed in claim 11 including continuing the depression of the temperature set point until a time period in the excess of about 17 minutes occurs and thereafter having the microprocessor raise the set point towards an original setting of about 1° F. in about 30 minutes.

13. A system as claimed in claim 5 including depressing the temperature for a different predetermined number of degrees at a preselected time interval and wherein the amount of depression is at least one of cumulative or preset, and wherein the timing and the amount of temperature increments to return to an original setting is selectable.

14. A system as claimed in claim 5 including presetting the temperature control to the maximum set point or selectively at any selected set point.

15. A system as claimed in claim 8 including depressing the temperature for a different predetermined number of degrees at a preselected time interval, and wherein the amount of depression is at least one of cumulative or preset, and wherein the timing and the temperature increment to return to an original setting is selectable.

16. A method of controlling a hot water heater including a reservoir for containing hot water, a cold water feed for the reservoir, a hot water exit for the reservoir, means for supplying energy to heat water in the reservoir; a thermostat temperature monitoring probe associated with the reservoir comprising the step of relating the temperature of the water, frequency of water removal to control the operation of the energy means for supplying heat to the reservoir.

17. A method as claimed in claim 16 wherein frequency of water removal is determined by temperature monitoring.

18. A method of claim 16 wherein frequency of water removal is determined by pressure monitoring.

19. A method of claim 16 wherein frequency of water removal is determined by flow monitoring.

20. A method as claimed in claim 16 including periodically depressing a temperature control set point in response to the water temperature and frequency of use.

21. A method as claimed in claim 20 including depressing the temperature control set point to compensate for the difference in pressure between the top of a water reservoir and the bottom of a water reservoir.

22. A method as claimed in claim 16 including depressing the temperature for a different predetermined number of degrees at a preselected time interval and wherein the amount of depression may be at least one of cumulative or preset, and wherein the timing and the amount of temperature increments to return to an original setting is selectable.

* * * * *